US005943038A

United States Patent [19]

Ikumi

[11] Patent Number: 5,943,038

[45] **Date of Patent: *Aug. 24, 1999**

[54] LIQUID CRYSTAL DISPLAY PANEL

[75] Inventor: Nobuyuki Ikumi, Tokyo, Japan

[73] Assignee: Kabushiki Kaisha Toshiba, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/760,705

[22] Filed: Dec. 5, 1996

[30] Foreign Application Priority Data

Dec. 8, 1995 [JP] Japan ..... 7-320668

[51] Int. Cl.[6] ..... G09G 5/36

[52] U.S. Cl. ..... 345/139; 345/422

[58] Field of Search ..... 345/138, 139, 345/140, 422; 364/518

[56] References Cited

U.S. PATENT DOCUMENTS 4,965,751 10/1990 Thayer et al. ..... 364/518
4,970,636 11/1990 Snodgrass et al. ..... 364/518
5,029,105 7/1991 Coleman et al. ..... 364/518
5,157,385 10/1992 Nakao et al. ..... 345/139
5,341,462 8/1994 Koei Obata ..... 395/122
5,706,479 1/1998 Winner et al. ..... 395/509

*Primary Examiner*—Mark K. Zimmerman
*Assistant Examiner*—Ronald Laneau
*Attorney, Agent, or Firm*—Foley & Lardner

[57] ABSTRACT

An LCD panel capable of displaying three-dimensional images has, for each pixel, a transparent part and an opaque active element region. The active element region includes an input unit for receiving depth data including at least a depth and supplying the depth data to the pixel, a holder (Zc) for holding depth data, and a determination unit for determining which one of the depth data provided by the input unit and stored in the holder (Zc) is shallower, i.e., closer to a display screen than the other. The determined depth is used to display an object on the pixel.

17 Claims, 6 Drawing Sheets

LIQUID CRYSTAL DISPLAY PANEL

BACKGROUND OF THE INVENTION

1. Field of the Invention

The present invention relates to a liquid crystal display (LCD) panel, and particularly, to one capable of displaying three-dimensional graphics without employing an external Z buffer.

2. Description of the Prior Art

When displaying three-dimensional images, or overlapping two objects on a display, a computer may hide one whose depth is deeper than the other behind the other. This is called a "hidden surface removal" process. This process is usually achieved with the use of an external Z buffer. FIG. 1 shows a conventional display system consisting of a display unit 53 such as a cathode ray tube (CRT) or an LCD panel provided with a Z buffer 49. The Z buffer 49 is external to the display unit 53 and stores depths expressed with the pixels of the display unit 53. If a second depth to be assigned to a given pixel is shallower than a first depth presently assigned to the pixel, the second depth is written into a video RAM (VRAM) 51 so that the second depth is displayed. If the second depth is deeper than the first depth, the first depth is kept unchanged in the VRAM 51. The hidden surface removal is carried out by a central processing unit (CPU) or a graphic processor (GP) 47 that is external to the display unit 53.

The CPU 47 reads a depth for a given pixel out of the Z buffer 49, compares the read depth with a new depth internally calculated for the pixel, and writes a deeper one of the depths with related intensity and RGB data into the VRAM 51 and Z buffer 49.

Employing the external Z buffer 49 is the easiest way to carry out the hidden surface removal but is expensive. To display a color image with red (R), green (G), and blue (B) colors each represented with 8 bits for each pixel, i.e., 24 bits in total per pixel, the VRAM 51, which is usually a DRAM, must have a capacity of about 4 MB for a screen size of 1280×1024 pixels. If the number of bits used for each color is reduced, the capacity of the DRAM may be 1 to 2 MB. The size of the Z buffer 49 is dependent on depth resolution. A depth resolution of 16 to 24 bits requires the capacity of the Z buffer 49 to be equal to or greater than that of the VRAM 51, thereby increasing the cost of the display system.

If the CPU 47 uses data pins of the Z buffer 49 commonly for read, compare, and write operations, the operations must be sequential to delay a processing speed. Then, it is difficult to display images in real time.

To solve this problem, a dual-port DRAM may be employed as the Z buffer. The CPU 47 reads a depth through the serial port, compares it with an internally calculated depth, and writes data into the DRAM under a high-speed mode such as a page mode or a nibble mode according to a pipeline method. This technique may improve the processing speed but double the number of data pins, complicate control, and increase the cost of the display system.

SUMMARY OF THE INVENTION

An object of the present invention is to provide a low-cost LCD system having a LCD panel capable of displaying three-dimensional graphics without an external Z buffer or complicated control system.

The prior art employing the external Z buffer is unable to provide a compact high-resolution display. The compact displays are realized only with a novel technique that needs no external Z buffer when carrying out the hidden surface removal. The inventor of the present invention has put an eye on utilizing an active element region 1 (FIG. 2) formed in each pixel of a standard LCD panel to eliminate the external Z buffer. The region 1 is opaque and contains active elements such as thin film transistors (TFTs) that control transparent cells 11R, 11G, and 11B of the pixel. The opaque region 1 is sufficiently large for the present technology to form about 5000 gates of TFT elements, and therefore, the opaque region 1 may be used to contain the same function of the Z buffer.

Namely, the present invention uses the opaque region 1 of each pixel to store a depth, compare the depth with a new depth, and display a selected one of the depths on the pixel.

More precisely, an LCD panel according to the present invention consists of many pixels each having transparent part, or cells 11R, 11G, and 11B, an opaque part (active element region) 1, and a hidden surface removal means formed in the opaque active element region 1. The hidden surface removal means temporarily stores a depth, compares the depth with a new depth, and displays a shallower one of the depths on the pixel. The pixels may be arranged in an X-Y matrix as shown in FIG. 4.

The hidden surface removal means of each pixel includes an input means for supplying depth data related to the pixel, a hold means for holding a depth to display, and a determination means for determining which one of the input and stored depths is shallower than the other. The shallower one is displayed on the pixel. The input means may correspond to an X decoder 31, a Y decoder 33, latches 35 and 37, a Z bus 17 for supplying depth data, and a control bus (VLZ bus) 27 as shown in FIG. 4.

In FIG. 2, the hold means consists of a first hold means 3 for storing a depth provided by the input unit, a second hold means 7 for storing a depth to display, and a selection means such as a selector 5 for selecting, according to the output of the determination means 9, one of the depths stored in the hold means 3 and 7. The selected depth is stored in the second hold means 7.

In this way, the present invention forms the hidden surface removal means in the active element region 1 of each pixel of the LCD panel, and therefore, there is no need of arranging an external Z buffer for the LCD panel, thereby reducing the cost and size of the LCD system and improving a processing speed without increasing the number of data pins in the LCD system.

The second hold means 7 is reset in response to a clear signal provided through a clear bus 21. The second hold means 7 stores a shallower depth determined by the determination means 9 and must be reset when displaying a new object. The present invention resets the second hold means 7 by hardware, to reduce load on software and improve the efficiency of program execution.

The first hold means 3 may be a first register (Zt) 3, and the second hold means 7 may be a second register (Zc) 7. These registers are manufacturable simultaneously with the pixels without an additional manufacturing process.

The determination means 9 may be a comparator for comparing a depth stored in the first register 3 with a depth stored in the second register 7 and determining which one of them is shallower than the other. The comparator is manufacturable simultaneously with the pixels without an additional manufacturing process.

Depth data supplied to a given pixel through the bus 17 is stored in the first hold means 3 in response to a control signal provided through the bus 27.

In this way, the present invention efficiently supplies depth data to each pixel. The hold means 3 and 7 and determination means 9 may be formed on the opaque active element region in the vicinity of existing buses for supplying display data, to improve design efficiency.

Each of the transparent parts, or transparent LCD cells 11R, 11G, and 11B is divided into subcells having a given area ratio as shown in FIG. 3, which shows only the red (R) cell 11R divided into subcells R0, R1, R2, and R3. The active element region 1 of each pixel may include intensity level adjusters 15R, 15G, and 15B for adjusting the transparency of the subcells according to given intensity levels.

The transparent cells 11R, 11G, and 11B of each pixel may be red (R), green (G), and blue (B) cells that are controlled according to depth data and red, green, and blue intensity data. The transparent cells 11R, 11G, and 11B are provided with intensity level holders 13R, 13G, and 13B formed in the active element region 1 to store red, green, and blue intensity data.

A mode bus 43 (for example, as shown in FIG. 6) may be prepared to transmit a mode signal to each pixel. The mode signal indicates whether or not the hidden surface removal must be carried out. In this case, the active element region 1 of each pixel further has a unit 45 for receiving the mode signal and selectors 5R, 5G, and 5B for selecting the intensity data stored in the holders 13R, 13G, and 13B or newly input intensity data according to the mode signal. The selected intensity data are stored in the holders 13R, 13G, and 13B. This technique is useful to switch a program that needs the hidden surface removal and a program that does not need the same from one to another.

Other and further objects and features of the present invention will become obvious upon an understanding of the illustrative embodiments about to be described in connection with the accompanying drawings or will be indicated in the appended claims, and various advantages not referred to herein will occur to one skilled in the art upon employing of the invention in practice.

DETAILED DESCRIPTION OF THE EMBODIMENTS

Figure 1:
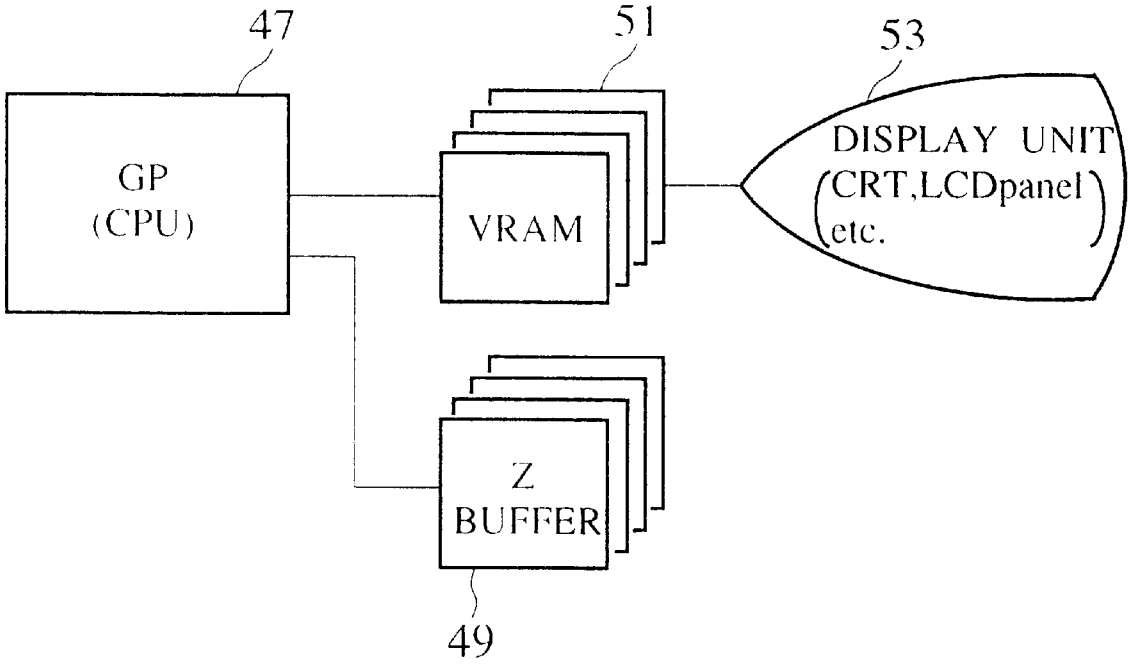
FIG. 1 PRIOR ART
FIG. 1 shows a conventional display system having an external Z buffer for carrying out the hidden surface removal.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

(First embodiment)

Figure 2:
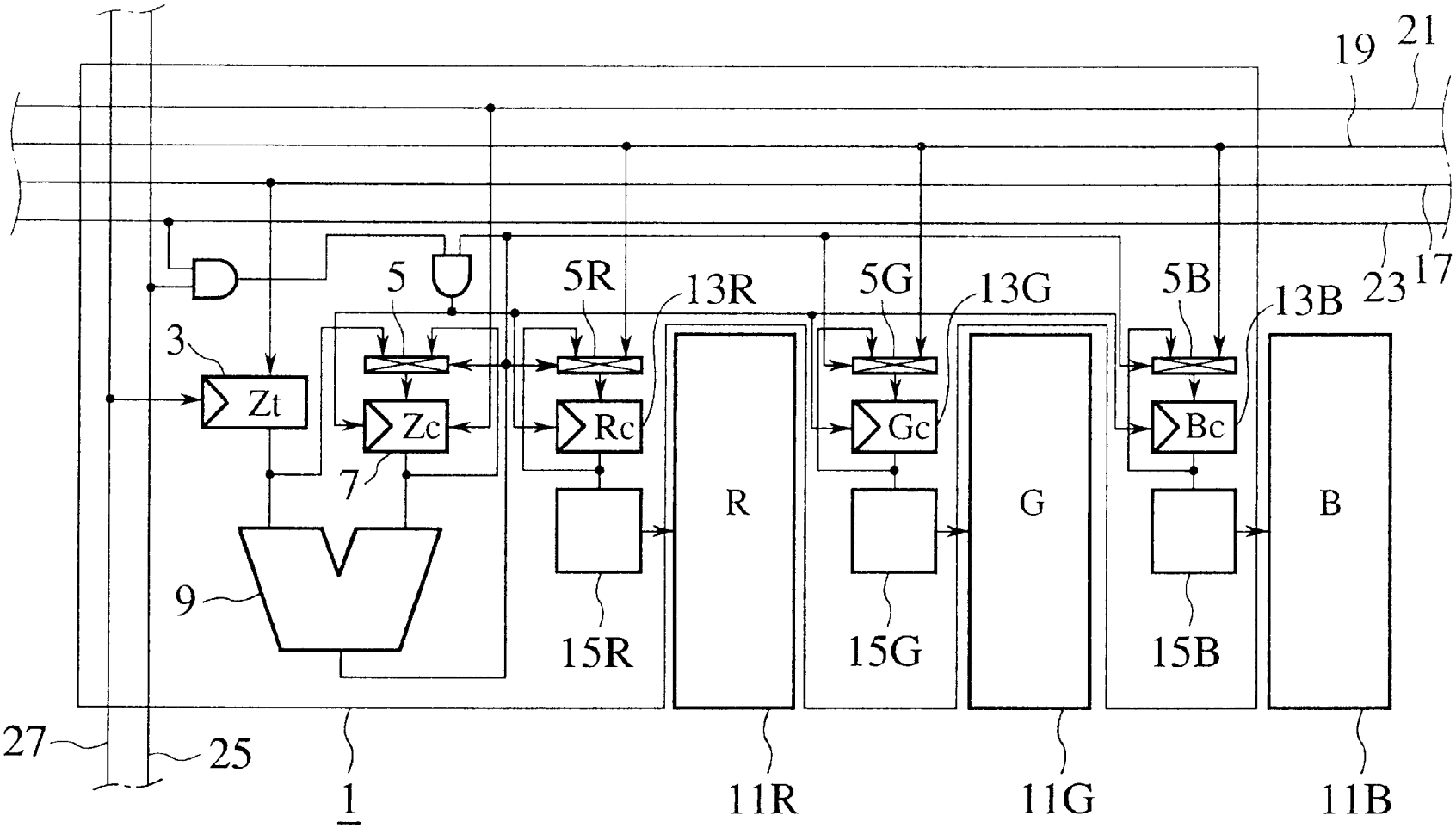
FIG. 2 is a model showing a pixel of an LCD panel according to a first embodiment of the present invention.

FIG. 2 is a model showing a pixel of an LCD panel according to the first embodiment of the present invention. The pixel consists of transparent cells (transparent parts) 11R, 11G, and 11B and an opaque active element region (opaque part) 1. FIG. 2 is only a schematic model, and the dimension and/or ratio of the areas of these cells and region is not equal to a real one.

The cells 11R, 11G, and 11B are red (R), green (G), and blue (B) transparent cells, which are driven by active elements such as TFTs formed in the opaque region 1. The opaque region 1 includes a hidden surface removal unit serving as a hidden surface removal means to display a shallower object. The hidden surface removal unit consists of a first register 3 (Zt) as a first hold means for storing a depth, a second register 7 (Zc) as a second hold means for storing a depth, a comparator 9 as a determination means for comparing the depths with each other, and a selector 5. The cells 11R, 11G, and 11B are provided with registers 13R, 13G, and 13B for storing red, green, and blue data, and selectors 5R, 5G, and 5B.

The register 3 receives a depth from a Z bus 17 in response to a control signal sent through a bus 27 (VLZ) and stores the depth. The selector 5 selects one of the depths stored in the registers 3 and 7 according to the output of the comparator 9 and stores the selected one in the register 7. The depth stored in the register 7 is shallower than the other, i.e., closer to a display screen than the other. The register 7 is connected to a clear bus 21, which transmits a clear signal to reset the register 7 when displaying a new object. Resetting the register 7 by hardware reduces load on a software program and improves the execution efficiency of the program. The comparator 9 compares the depths stored in the registers 3 and 7 with each other, determines which one of them is shallower than the other, and provides a determination signal.

According to the determination signal, the selector 5 selects the shallower depth.

The determination signal is also supplied to the selectors 5R, 5G, and 5B to let them select data supplied through an RGB bus 19 or data stored in the registers 13R, 13G, and 13B. The selected data are stored in the registers 13R, 13G, and 13B and are used by drivers 15R, 15G, and 15B to drive the cells 11R, 11G, and 11B, respectively.

Figure 3:
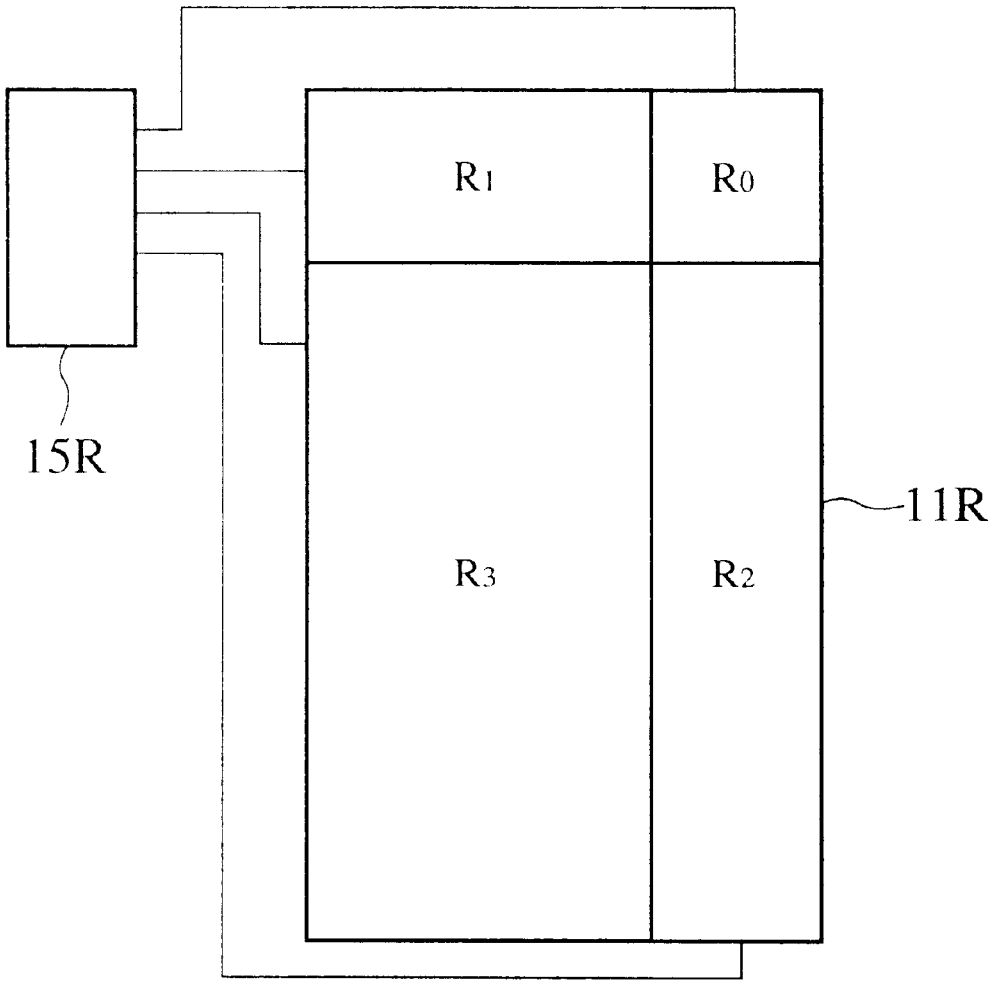
FIG. 3 shows the details of a red (R) cell in the pixel of FIG. 2.

A method of driving the cells 11R, 11G, and 11B with the drivers 15R, 15G, and 15B will be explained. FIG. 3 shows the details of the red (R) cell 11R. The green (G) cell 11G and blue (B) cell 11B are each the same as the R cell 11R. To adjust the transparency, i.e., brightness of the R cell 11R, the R cell 11R is divided into subcells R0 to R3, which are turned on and off to provide one of 16 intensity levels. The ratio of the areas of the subcells R0 to R3 is 1:2:4:8 to provide 16 intensity levels represented with four bits. The red, green, and blue cells 11R, 11G, and 11B have each 16 intensity levels to provide 4012 (16×16×16) colors in total. Although the first embodiment relates to an RGB LCD panel, the present invention is also applicable to monochrome LCD panels.

Figure 4:
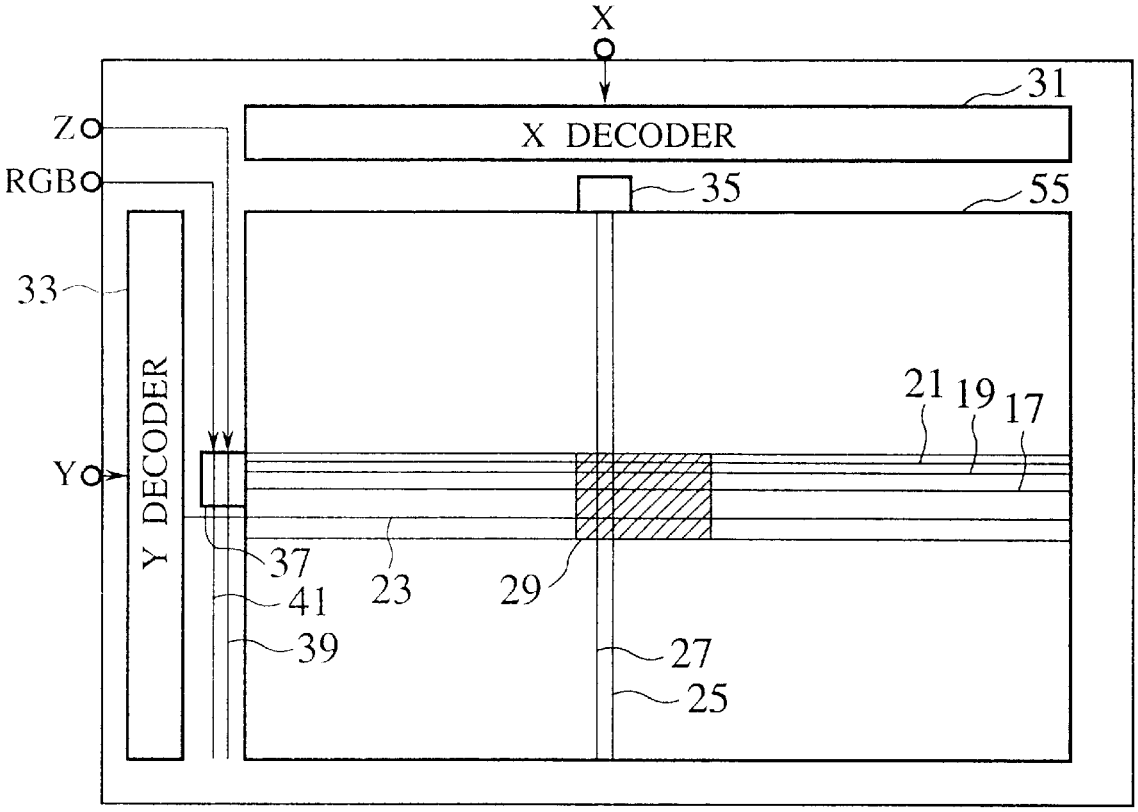
FIG. 4 is a block diagram generally showing the LCD panel according to the first embodiment.

FIG. 4 is a block diagram generally showing the LCD panel of the present invention. The display part 55 consists of a matrix of pixels. Each pixel 29 (enlarged for the sake of explanation) receives display data through the buses 17, 19, 21, 23, 25, and 27. There is an active element area mainly containing TFTs around the display part 55. This area includes an X decoder 31 and a Y decoder 33. The Y decoder 33 activates each horizontal select line 23 (WL or word line), and the X decoder 31 activates the vertical select lines 25 (VLI) and 27 (VLZ), so that each pixel 29 is specified with X and Y coordinates. Each horizontal Z bus 17 provides each pixel 29 with depth data, and each horizontal RGB bus 19 provides each pixel 29 with intensity data. The bus 27 provides each pixel 29 with a signal to let the pixel 29 receive depth data Z from the bus 17, and the bus 25 provides each pixel 29 with a signal to let the pixel 29 receive intensity data from the bus 19.

Figure 5:
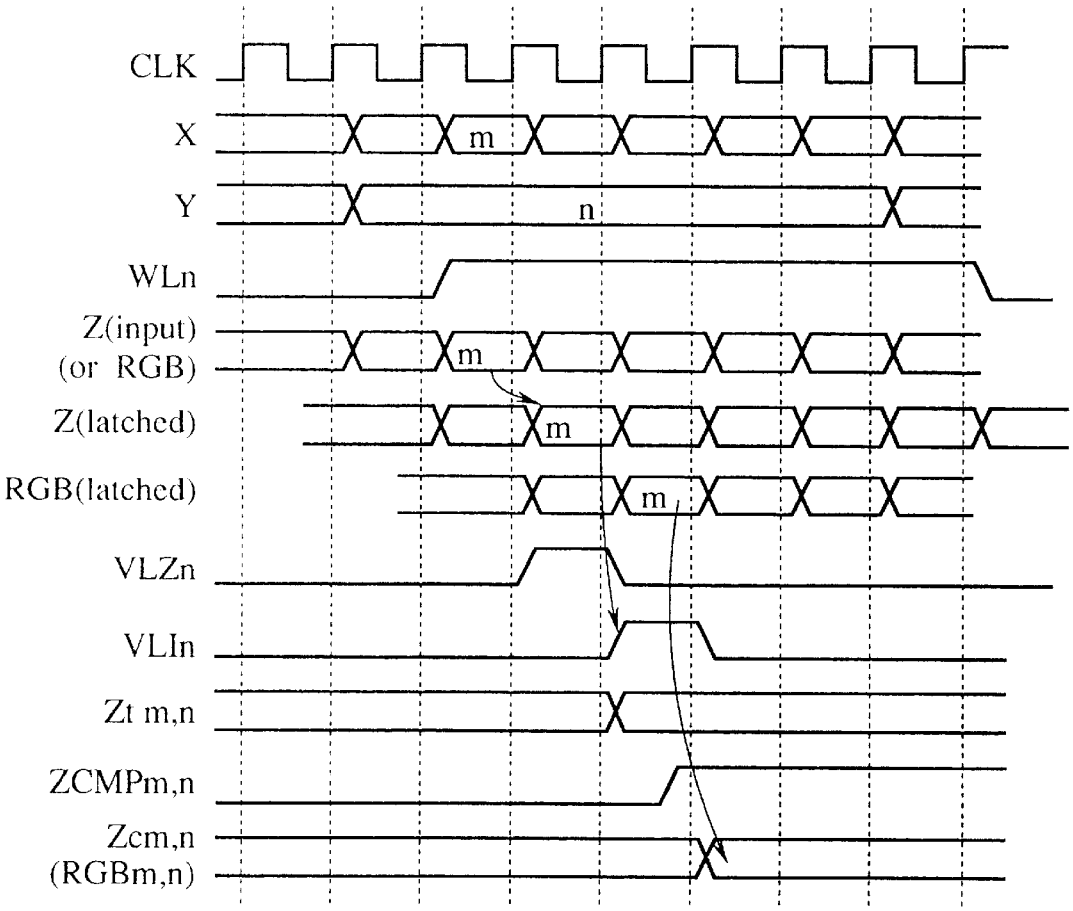
FIG. 5 is a timing chart showing the operation of the LCD panel according to the first embodiment.

FIG. 5 is a timing chart showing the operation of the pixel of FIG. 2. In this example, the pixel is positioned at an intersection (m, n) between a vertical line m and a horizontal line n. When the bus 23 (WL) is active, a pulse is applied to activate the bus 27 (VLZ) to write a depth from the Z bus 17 into the register 3. In the next cycle, the depths stored in the registers 7 and 3 are compared with each other. If the depth in the register 3 is equal to or smaller than the depth in the register 7, the depth in the register 7 is deeper than the depth in the register 3. In response to a pulse in the bus 25 (VLI) in the next cycle, R, G, and B intensity levels on the RGB bus 19 are written into the registers 13R (Rc), 13G (Gc), and 13B (Bc). At the same time, the depth in the register 3 is written into the register 7. Since the RGB intensity levels are one clock behind the depth Z, the depth Z is stored in the latch 37 and is delayed. If the depth in the register 3 is greater than the depth in the register 7, the depth in the register 7 is shallower than the depth in the register 3, and therefore, the depth in the register 7 is unchanged.

In this way, according to the present invention, what the CPU or GP must carry out is only providing the LCD panel with depth data and R, G, and B data, and the LCD panel carries out the hidden surface removal accordingly.

(Second embodiment)

Figure 6:
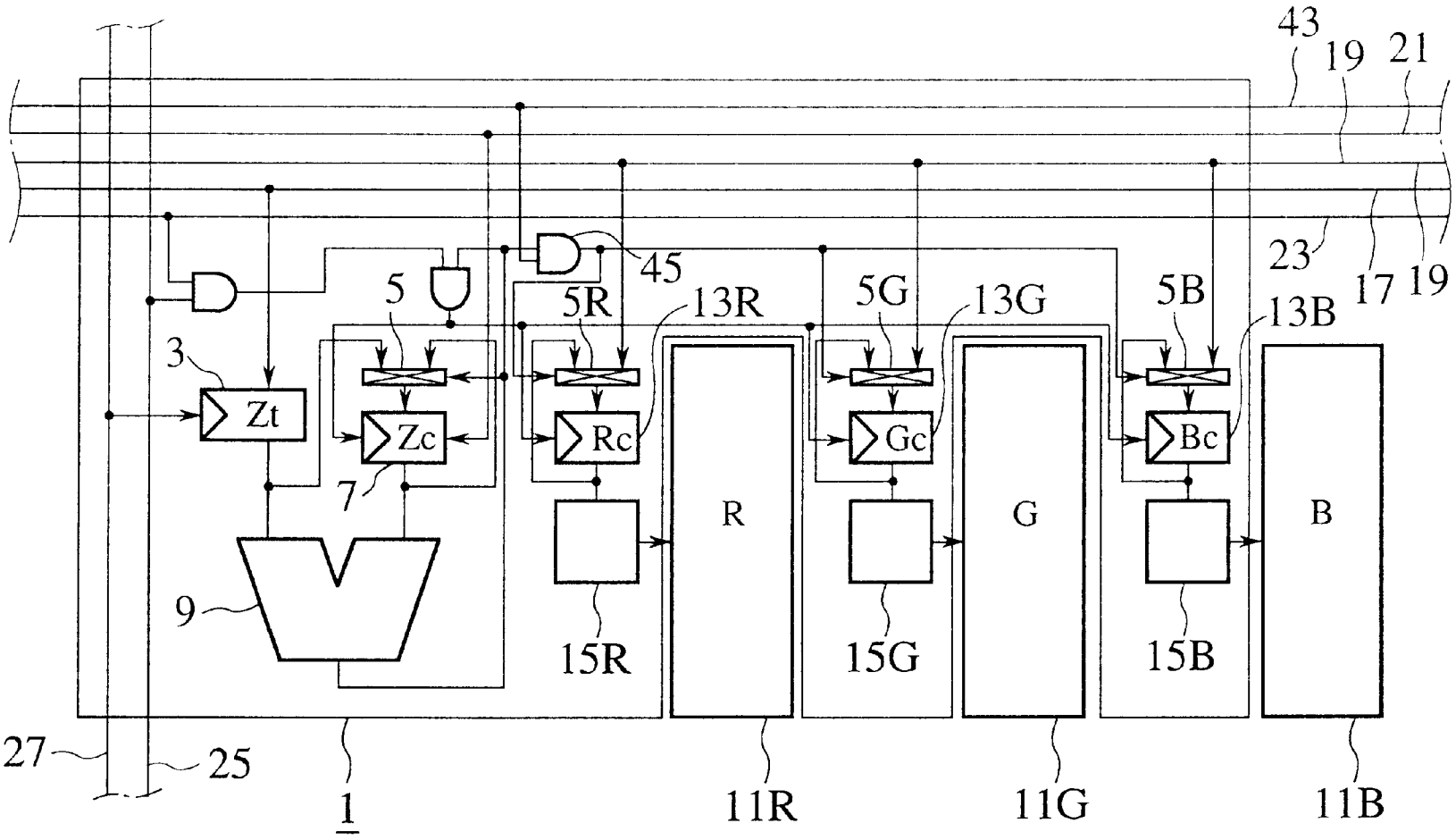
FIG. 6 is a model showing a pixel of an LCD panel according to a second embodiment of the present invention.

An LCD panel according to the second embodiment of the present invention will be explained with reference to FIG. 6. The LCD panels are applicable to various kinds of computer systems such as a personal computer. A personal computer having the LCD panel carries out a variety of programs including one that three-dimensionally displays images and one that two-dimensionally displays images. It is convenient, therefore, to turn on and off the hidden surface removal depending on a program to execute.

The second embodiment has a mode bus 43 in addition to the arrangement of the first embodiment. An AND of a signal sent through the mode bus 43 and a determination signal from a comparator 9 is supplied to selectors 5R, 5G, and 5B. The other parts of the second embodiment are the same as those of the first embodiment. Namely, each pixel of the LCD panel has red, green, and blue transparent cells 11R, 11G, and 11B around which an opaque active element region 1 containing TFTs, etc., is formed. The region 1 contains a hidden surface removal unit to display a shallower object. The hidden surface removal unit has a register 7 (Zc) for storing a depth to display, a register 3 (Zt) for storing a new depth, the comparator 9 for comparing these depths with each other, and a selector 5. Registers 13R, 13G, and 13B store R, G, and B data. The register 3 receives a depth through a Z bus 17 in response to a signal on a bus 27 (VLZ). The selector 5 selects one of the depths stored in the registers 3 and 7 according to the output of the comparator 9. The selected one is stored in the register 7. The depth stored in the register 7 is shallower, i.e., closer to a display screen and is displayed. The register 7 is connected to a clear bus 21, which transmits a clear signal to reset the register 7 when displaying a new object. Resetting the register 7 by hardware reduces load on a program and improves the execution efficiency of the program. The comparator 9 determines which one of the depths stored in the registers 3 and 7 is deeper than the other. The output of the comparator 9 is supplied to the selector 5 and an AND circuit 45. The AND circuit 45 provides the selectors 5R, 5B, and 5G with an AND of a signal on the mode bus 43 and the output of the comparator 9.

When the mode signal is "1," the output of the comparator 9 is supplied to the selectors 5R, 5G, and 5B to carry out the hidden surface removal. When the mode signal is "0," the same is not supplied to the selectors, to disable the hidden surface removal. In this way, the hidden surface removal is enabled or disabled depending on a program to execute.

The active element region 1 of each pixel of the LCD panel is always formed because it is an essential part of the panel. The cost of a mask pattern used to form the active element region is substantially unchanged even if the number of elements to be formed in the region is increased according to the present invention. Namely, the present invention involves no cost increase. In addition, the present invention requires no external Z buffer, reduces the number of parts and the number of pins of a graphic processor, and eliminates complicated control, thereby reducing the cost of the LCD system. Namely, the present invention enables the LCD panel to display three-dimensional graphics at low cost.

Various modifications will become possible for those skilled in the art after receiving the teachings of the present disclosure without departing from the scope thereof. Although the LCD panels of the first and second embodiments are driven by TFTs, the present invention is applicable to LCD panels driven by any other types of active elements.

As explained above, the present invention provides a low-cost LCD panel capable of displaying three-dimensional graphics without an external Z buffer.

What is claimed is:

1. A liquid crystal display panel for displaying three-dimensional images comprising:

an X decoder;

a Y decoder;

a plurality of horizontal z buses for supplying depth data;

a plurality of clear buses running parallel with said horizontal z buses for supplying a clear signal;

a plurality of intensity buses running parallel with said horizontal z buses for supplying intensity levels;

a plurality of vertical select lines; and a plurality of pixels arranged in an X-Y matrix, each pixel comprising:

hidden surface removal means connected to one of said z buses, one of said clear buses and one of said vertical select lines, for holding and determining an object that is shallowest from a surface of a display screen among objects forming the three-dimensional image so as to display the determined object on a transparent part of the pixel; and intensity level adjusting means connected to said hidden surface removal means and one of said intensity buses, for adjusting a transparency of the transparent part.

2. The panel of claim 1, wherein the depth data includes at least a depth and red, green, and blue intensity levels, the transparent part has red, green, and blue transparent parts, and the active element region further has intensity level hold means for the red, green, and blue transparent parts, respectively, for holding the red, green, and blue intensity levels, respectively.

3. The panel of claim 2, which further includes:

a plurality of mode bases running parallel with said horizontal z buses for transmitting a mode value indicating whether or not the hidden surface removal must be carried out;

mode value input means connected to one of said mode buses for supplying a mode value to the pixels; and selection means for selecting the intensity levels stored in the intensity level hold means or the intensity levels provided by the intensity bus and providing the intensity level hold means with the selected intensity levels.

4. A liquid crystal display panel for displaying three-dimensional images having a plurality of pixels arranged in an X-Y matrix, an X decoder, a Y decoder, a plurality of horizontal z buses for supplying depth data to each pixel, a plurality of vertical select lines, each pixel has a hidden surface removal means, the hidden surface removal means comprising:

(a) hold means connected to one of said horizontal z buses and one of said vertical select lines, disposed in an opaque part of the pixel for holding a depth among the depth data to be displayed on the pixel; and (b) determination means connected to said hold means, disposed in the opaque part of the pixel for determining which one of the depths is shallower than the other, the determined shallower depth being displayed on a transparent part of the pixels.

5. The panel of claim 4, wherein the hold means comprises:

(a) first hold means connected to one of said horizontal z buses and one of said vertical select lines, for holding the depth provided by the bus;

(b) second hold means for holding the depth to display; and (c) selection means connected to output sides of said first and second hold means, for selecting one of the depths stored in the first and second hold means according to the output of the determination means, and supplying the selected one to the second hold means.

6. The panel of claim 5, further comprising a plurality of clear buses running parallel with said horizontal z buses, wherein the second hold means is connected to one of said clear buses so as to be reset in response to a clear signal sent through said clear buses.

7. The panel of claim 6, wherein the determination means includes a comparator for comparing the depths stored in the first and second hold means with each other, to determine which one of the depths is shallower than the other.

8. The panel of claim 5, wherein the first hold means is a first register and the second hold means is a second register.

9. The panel of claim 8, wherein the determination means employs a comparator for comparing the depths stored in the first and second hold means with each other, to determine which one of the depths is shallower than the other.

10. The panel of claim 8, wherein the transparent part is divided into subcells having a given area ratio, and further comprising:

a plurality of intensity buses running parallel with said horizontal z buses;

a selector connected to one of said intensity buses;

a register connected to said selector; and intensity level adjusting means connected to said register for adjusting a transparency of each of the subcells according to the intensity level sent through one of said intensity buses.

11. The panel of claim 5, wherein the determination means includes a comparator for comparing the depths stored in the first and second hold means with each other, to determine which one of the depths is shallower than the other.

12. The panel of claim 5, wherein the transparent part is divided into subcells having a given ratio, further comprising:

a plurality of intensity buses running parallel with said horizontal z buses;

a selector connected to one of said intensity buses;

a register connected to said selector; and intensity level adjusting means connected to said register for adjusting a transparency of each of the subcells according to the intensity level sent through one of said intensity buses.

13. The panel of claim 4, wherein the determination means includes a comparator for comparing the depth provided by the bus with the depth stored in the hold means, to determine which one of the depths is shallower than the other.

14. The panel of claim 13, wherein the transparent part is divided into subcells having a given area ratio, further comprising:

a plurality of intensity buses running parallel with said horizontal z buses;

a selector connected to one of said intensity buses;

a register connected to said selector; and intensity level adjusting means connected to said register for adjusting a transparency of each of the subcells according to the intensity level sent through one of said intensity buses.

15. The panel of claim 4, wherein the transparent part is divided into subcells having a given area ratio, further comprising:

a plurality of intensity buses running parallel with said horizontal z buses; and intensity level adjusting means connected to said hidden surface removal means and electrically coupled to said one of said intensity buses for adjusting a transparency of each of the subcells according to the intensity level sent through one of said intensity buses.

16. The panel of claim 15 wherein:

said intensity buses transmit at least a depth and red, green, and blue intensity levels;

the transparent part has red, green, and blue transparent parts; and an opaque part in each pixel has intensity level hold means for the red, green, and blue transparent parts, respectively, for holding the red, green, and blue intensity levels, respectively.

17. The panel of claim 16, which further includes:

a plurality of mode bases running parallel with said horizontal z buses for transmitting a mode value indicating whether or not the hidden surface removal must be carried out;

mode value input means connected to one of said mode buses for supplying the mode value to the pixel; and selection means for selecting the intensity levels stored in the intensity level hold means or the intensity levels provided by the intensity bus and providing the intensity level hold means with the selected intensity levels.

* * * * *